United States Patent [19]

Schuh et al.

[11] Patent Number: 4,674,580

[45] Date of Patent: Jun. 23, 1987

[54] MEANS FOR REDUCING BENDING STRESSES IN DRILL PIPE

[75] Inventors: Frank J. Schuh, Plano; David D. Hearn, Richardson, both of Tex.

[73] Assignee: Atlantic Richfield Company, Los Angeles, Calif.

[21] Appl. No.: 770,147

[22] Filed: Aug. 27, 1985

[51] Int. Cl.[4] ..... E21B 7/04; E21B 17/10

[52] U.S. Cl. ..... 175/325; 175/61; 175/76

[58] Field of Search ..... 175/325, 73, 76, 61

[56] References Cited

U.S. PATENT DOCUMENTS

| | | | |
|---|---|---|---|
| 2,877,062 | 3/1959 | Hall et al. | 175/325 |
| 4,428,441 | 1/1984 | Dellinger | 175/325 |
| 4,577,701 | 3/1986 | Dellinger et al. | 175/73 |

FOREIGN PATENT DOCUMENTS

| | | | |
|---|---|---|---|
| 3101060 | 7/1982 | Fed. Rep. of Germany | 175/325 |

*Primary Examiner*—Stephen J. Novosad
*Assistant Examiner*—Terry Lee Melius
*Attorney, Agent, or Firm*—F. Lindsey Scott; Drude Faulconer

[57] ABSTRACT

A means for substantially reducing the bending stresses, both tensional and compressional, in a standard-type length of drill pipe as it passes through a section of a wellbore that is deviated from vertical. The tool joints on the ends of drill pipe have outside diameters greater than that of the pipe body which act as supports for the pipe body against the wall of the wellbore in a deviated section. The bending stresses encountered by the drill pipe increase as the distance between these pipe supports increase. In the present invention, stress sleeves are affixed to the outer surface of the pipe body at equally spaced intervals between the tool joints to act as dummy tool joints thereby providing additional pipe supports which substantially reduce the bending stresses in the drill pipe.

4 Claims, 6 Drawing Figures

MEANS FOR REDUCING BENDING STRESSES IN DRILL PIPE

DESCRIPTION

1. Technical Field

The present invention relates to a means for reducing the bending stresses in a drill pipe and more particularly relates to a drill pipe having stress sleeves positioned along its length to thereby reduce the bending stresses in the pipe when it is deviated from vertical during drilling operations.

2. Background Art

The basic design of the drill string used in the drilling of typical wells has not substantially changed since its inception many decades ago. The drill string is made up of individual lengths (e.g. from 27 to 45 feet in length) of standard drill pipe which are joined together by pin and box tool joints which, in turn, have larger outside diameters than that of the body of the pipe. These strings were originally designed to drill relatively shallow, straight vertical wells but are now routinely used in drilling much deeper wells and in drilling specially curved wellbores (e.g. drain holes) for increased recovery. However, it is recognized that a standard drill string undergoes adverse forces during drilling which substantially shorten the fatigue life of the drill pipe, especially where the drill string is subjected to high tensional and/or compressional axial loads such as those encountered in drilling deep and curved wellbores.

One major source of such adverse forces is the bending stresses which are applied to the drill pipe whenever the drill string is required to deviate from vertical within the wellbore during drilling. For example, it is not uncommon for a "vertical" wellbore to contain one or more crooked sections (called "dog legs") at varying depths along its length. Since all standard drill pipe is equipped with the larger diameter tool joints, the bending stresses produced as the joined pipe passes through a dog leg are much greater than those stresses produced by merely bending a smooth pipe to conform to the curvature of the dog leg. In deeper wells (e.g. 15,000 feet or deeper) where the weight of the string applies high axial tensional loads to the drill string, the reverse bending stresses encountered by rotating the drill pipe around and through a dog leg within the wellbore approach or exceed the stress limits of the standard drill pipe thereby causing early fatigue failure of the pipe.

Likewise, a standard drill string used in drilling the curved section of a horizontal wellbore undergoes similar bending stresses except these forces are compressional instead of tensional. These bending stresses can be excessive and can easily exceed the stress limits of the drill pipe, especially where the curvature of the section between the vertical and horizontal sections of the wellbore is high (e.g. 20° deviation per 100 foot of curvature). When a standard drill string is to be used in deep wells having dog legs or in wellbores having a highly curved section, some means must be provided to reduce the bending stresses in the pipe to acceptable limits or early fatigue failure of the pipe is likely to occur.

DISCLOSURE OF THE INVENTION

The present invention provides a means for substantially reducing the bending stresses during both tensional and compressional axial loads, in a standard-type length of drill pipe as it passes through a section of a wellbore that is deviated from vertical.

More specifically, the present invention provides a quick and relatively inexpensive means for changing the external configuration of a length drill pipe whereby the bending stresses are reduced to within acceptable levels as the drill pipe passes through a dog leg in a vertical wellbore or through a curved section of a horizontally-completed well. The drill pipe is standard-type drill pipe which has a pipe body with pin and box tool joints on the ends thereof which, in turn, have outside diameters greater than the outside diameter of the pipe body. These tool joints engage the wall of the curved section of the wellbore as the drill string passes therethrough and act as supports for the pipe body. The bending streses encountered by the drill pipe increase as the distance between these pipe supports increase.

In accordance with the present invention, one or more cylindrical, stress sleeves are affixed to the outer surface of the pipe body at equally spaced intervals between the tool joints. Each sleeve has an outside diameter substantially equal to the outside diameter of the tool joint and is preferably of the same material as the tool joints, e.g. steel. In effect, the stresses sleeves act as dummy tool joints thereby providing additional pipe supports which engage the curved section wellbore wall as the pipe passes therethrough. Since the sleeves are positioned between the tool joints, the distance between adjacent pipe supports on the pipe body is accordingly reduced thereby substantially reducing the bending stresses in the drill pipe.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
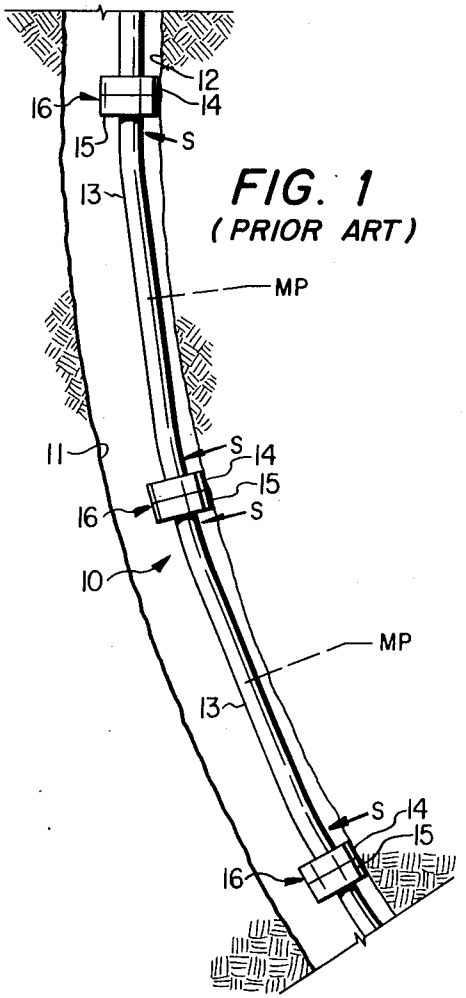
FIG. 1 (PRIOR ART)
FIG. 1 is a sectional view of a typical prior art drill string under tension as it passes through a portion of dog leg in a vertical wellbore.

To better understand the present invention, a brief discussion of prior art, standard drill strings and how they may experience excessive bending stresses during drilling will first be set forth. Referring now to FIG. 1, a typical drill string 10 is disclosed passing through a dog leg section 11 of a wellbore 12. Drill string 10 is comprised of individual lengths (e.g. 30 foot long) of standard drill pipe 13 which, as understood in the art, are connected together with mating pin 14 and box 15 members on the ends thereof to form tool joints 16. As shown in FIG. 1, drill string 10 is in tension as it passes through dog leg 11 during the drilling of a deep, "vertical" wellbore. As understood in the art, drill string 10 has heavy drill collars on its lower end (not shown) which apply the necessary weight onto the drill bit for drilling. The drill string is routinely designed so that the string above the drill collars remain in tension with only the drill collars being in compression.

If drill string 10 were of equal outside diameter throughout its length, it would smoothly bend against the upside of wellbore 12 to conform to the curvature of dog leg 11 as it is pulled therethrough by the weight of the drill collars. However, as stated above, string 10 is comprised of standard drill pipe which have tool joints which have larger outside diameters than that of the body of pipe 13. As shown in exaggerated illustration in FIG. 1, tool joints 16 will contact the upside of wellbore 12 to act as supports for string 10 as it is pulled through dog leg 11.

The tensional forces in string 10 will tend to straighten out the body of each length of drill pipe 13 at its midpoint MP between adjacent tool joints 16. This puts maximum alternating bending stresses at points S adjacent tool joints 16. From known deflection equations, it can be established that these bending stresses increase as to the distance or length between adjacent supports, i.e. tool joints 16. For example, the following equation gives the maximum curvature C of the body of drill pipe 13 as a function of curvature C of dog leg 11:

$$C = C_o\,(KL^{\circ}/\tanh(KL))$$

wherein:

K=T/EI (stiffness of pipe 13)

T=modulus of elasticity for material of pipe 13

I=Moment of Inertia in inches $^4$

Figure 6:
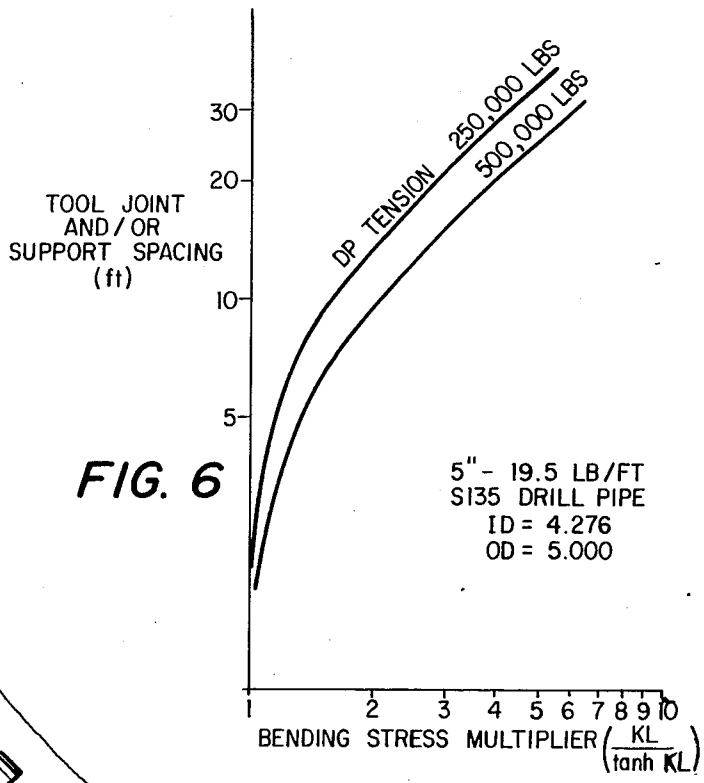
FIG. 6 is a graphic plot of a stress multiplier for a drill pipe as related to the spacing between pipe supports.

L=½ length of pipe 13 between joints 16 in inches tanh=hyperbolic tangent It will be noted that the term (KL/tanhKL) is a multiplier that increases the curvature of pipe 13 above that of the hole. In FIG. 6, a plot of this multiplier verses the distance between tool joints 16 is shown for a 5 inch outside diameter, S135 standard drill pipe when subjected to tensional loads of 250,000 and 500,000 pounds. As seen from this plot, the reverse bending streses can be significantly reduced for a given dog leg by reducing the distance between pipe supports, i.e. tool joints 16.

Similar adverse bending stresses are also produced by compressional forces when applied to drill string 10 as when the string is used to drill a horizontally-completed well. As known in the art, wells are now capable of being drilled which are first drilled to a certain vertical depth and then curved to a horizontal direction. In drilling the curved and horizontal sections of the wellbore, the drill bit and drill string has to be pushed into the hole thereby causing that portion of the drill string to be in compression. Drill collars are normally too stiff to pass easily through curved section 20 of wellbore 21 where the raduis of curvature is high as it is in the drilling of drainholes and the like. Also the stiffness of the heavy collars produce severe stress points at the couplings between collars when the collars are forced through a rapid curvature. Accordingly, it is common to place the heavy collars in the vertical section of the wellbore to apply weight downward onto a string of standard drill pipe which extends through the curved and horizontal sections of the wellbore.

Figure 3:
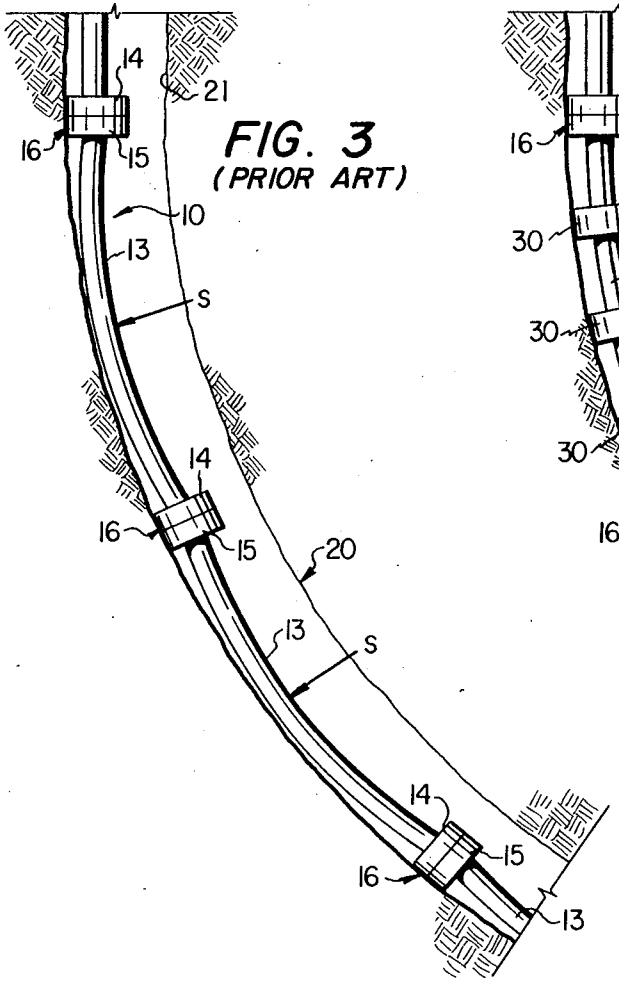
FIG. 3 (PRIOR ART)
FIG. 3 is a sectional view of typical prior art drill string under compression as it passes through a curved section of a horizontally-completed wellbore.

Such a string 10 of standard drill pipe 13 is shown in exaggerated fashion in FIG. 3 wherein tool joints 16 engage the lowside of curved section 20 as string 10 is pushed therethrough. Maximum bending stress 5 is produced in the body of each individual pipe length 13 at its midpoint tending to bow the pipe body outward toward the lowside of wellbore 21. Again, as is known from deflection analysis, these bending stresses increase as the distance increases between the pipe supports, i.e. tool joints 16.

Figure 5:
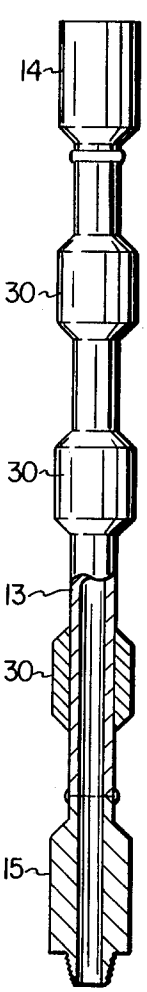
FIG. 5 is an elevational view, partly in section, of a length of drill pipe in accordance with the present invention.

In accordance with the present invention, the configuration of a length of standard drill pipe is changed to reduced the bending stresses produced in the pipe when it deviates from the vertical in a wellbore. Referring now to FIG. 5, a length (e.g. from 27 to 45 feet) of standard drill pipe is comprised of a pipe body 13 having a box connector 14 welded or otherwise secured at one end and a mating pin connector 15 welded or otherwise secured to the other end as will be understood by those skilled in the art. One or more cylindrical, stress sleeves 30 are affixed to outer wall of pipe body 13 at spaced intervals between connectors 14, 15. Sleeves 30 are preferably of the same material, e.g. steel, as that of connectors 14, 15 and have substantially the same outside diameter as same.

Each sleeve 30 may be split for assembly onto the pipe body 13 or can be slipped thereon before connector 14 or 15 is welded in place. The sleeves can be welded or otherwise secured in place and preferably are attached by a combined epoxy-welding technique such as used by Drilco, Division of Smith International, Inc., Houston, Texas, to secure wear pads on well casing.

The number of sleeves 30 required to reduce the bending stresses to an acceptable level will vary depending on factors such as size of the pipe, weight-on-bit requirement, curvature of the dog leg or curved section to be transversed. axial load in drill string, etc., and can be derived from known stress-strain relationship. Preferably, adjacent stress sleeves are positioned at equal distances from each other and from connectors 14, 15 so that they provide equal lengths of pipe body therebetween. For example, if one stress sleeve is sufficient, it would be positioned midway between connectors 14, 15 (i.e. 15 feet from connector on 30 foot length of pipe); if two sleeves are required, they would be positioned at one-third intervals (10 foot intervals on 30 foot length of pipe); if three sleeves were required, they would be positioned at one-fourth intervals (7.5 feet intervals of 30 foot length of pipe); and so on. It has been found in practice that no more than three sleeves are needed to maintain the bending stresses within acceptable limits for most standard sizes and lengths of drill pipe but additional sleeves can be used, if desired or required in special circumstances.

Figure 2:
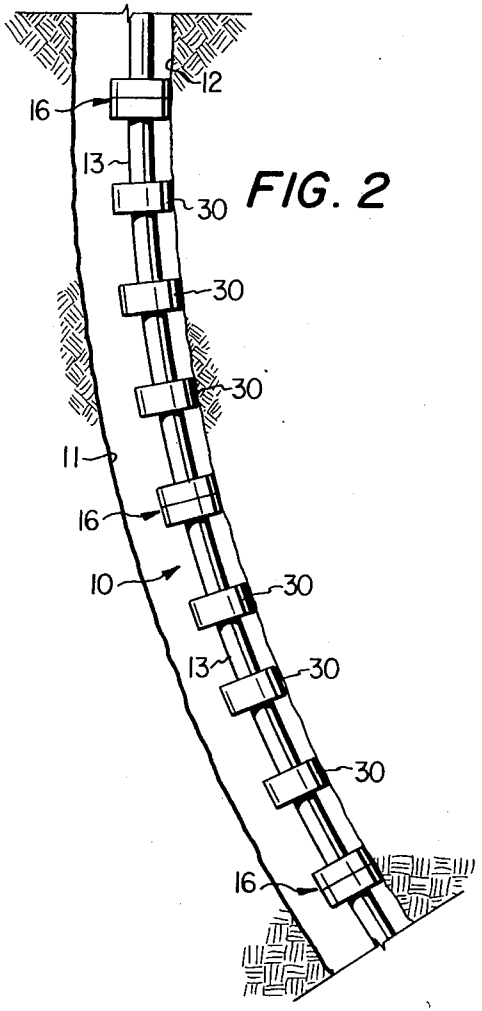
FIG. 2 is a sectional view of a drill string in accordance with the present invention under tension as it passes through the dog leg of FIG. 1.

As seen in FIG. 2, drill string 10 is made of lengths 13 of standard drill pipe having stress sleeves 30 thereon in accordance with the present invention. Sleeves 30 act as dummy tool joints, and, in turn, act as pipe supports in the same way as tool joints 16 by engaging the upside of dog leg 11 as string 10 passes therethrough. Since, as discussed above, the bending stresses in pipe 13 is reduced by reducing the distance between tool joints 16, sleeves 30 substantially reduces the bending stresses in drill string 10 caused by tensional loads as it deviates from vertical.

Figure 4:
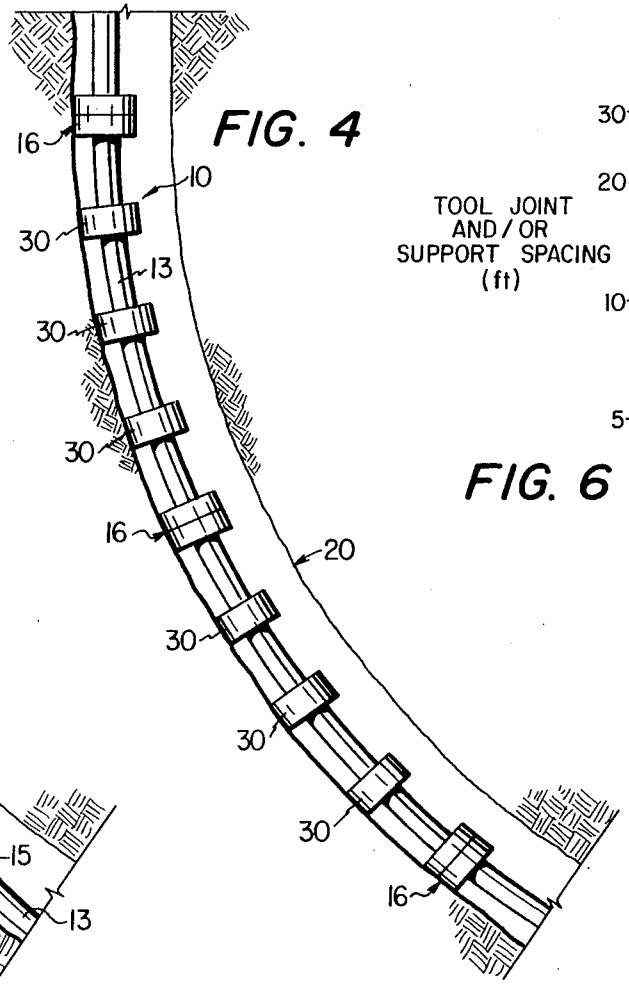
FIG. 4 is a sectional view of a drill string in accordance with the present invention under compression as it passes through the curved section of FIG. 3.

The same is true for string 10 when it is in compression as shown in FIG. 4. Sleeves 30 engage the lowside of the curved section 20 and act as pipe supports in the same way as do tool joints 16. The effective lengths of pipe body 13 are reduced so accordingly are the bending stresses produced by the compressional loads in string 10 as it passes through curved section 20.

As seen from the above description, sleeves 30 function in the same manner as do tool joints 16 in providing supports for the body of pipe 13 as it transverses a curved section of a wellbore whether the drill string is in tension or compression. In accordance with the present invention, a length of standard pipe becomes a plurality of shorter lengths due to the spacing of sleeves 30 on pipe body 13. This gives the same effect as if the plurality of shorter lengths were joined together by tool joints which, itself, is impractical due to economic considerations.

What is claimed is:

1. A drill string adapted for drilling wells having wellbore with a curved section therein; said drill string comprising:

a plurality of lengths of drill pipe, each of which comprise:

a pipe body;

a tool joint on either of said pipe body for connecting said lengths of drill pipe together, said tool joints having an outside diameter greater than the outside diameter of said pipe body;

said lengths of drill pipe which are adapted to pass through said curved section of said wellbore during operation further comprising:

at least one cylindrical stress sleeve concentrically mounted and fixedly secured to the outer surface of said pipe body, said at least one cylindrical sleeve having an outside diameter substantially equal to said outside diameter of said tool joints and spaced on said pipe body between and not abutting said tool joints whereby said sleeve will engage the wall of said curved section of said wellbore during operations along with said tool joints to act as pipe supports to substantially reduce bending stresses in said drill string as it passes through said curved section.

2. The drill string of claim 1 wherein said at least one stress sleeve comprises:

a plurality of cylindrical stress sleeves all of which have an outside diameter substantially equal to the outside diameter of said tool joints; each of said sleeves being concentrically mounted and fixedly secured to the outer surface of pipe body and spaced an equal distance from an adjacent sleeve or an adjacent tool joint so that the lengths of pipe body between adjacent sleeves and between said tool joint and an adjacent sleeve are substantially equal.

3. The drill string of claim 2 wherein said plurality of stress sleeves comprise:

two cylindrical stress sleeves concentrically mounted and fixedly secured to the outer surface of said pipe body and spaced at intervals thereon equal substantially to one-third of the length of said pipe body.

4. The drill string of claim 2 wherein said plurality of stress sleeves comprise:

three cylindrical stress sleeves concentrically mounted and fixedly secured to the outer surface of said pipe body and spaced at intervals thereon equal substantially to one-fourth of the length of said pipe body.

* * * * *

Dedication 4,674,580.—*Frank J. Schuh*, Plano; *David D. Hearn*, Richardson, both of Tex. MEANS FOR REDUCING BENDING STRESSES IN DRILL PIPE. Patent dated June 23, 1987. Dedication filed Mar. 1, 1990, by the assignee, Atlantic Richfield Co.

Hereby dedicates to the Public the remaining term of said patent.

[*Official Gazette May 15, 1990* ]